US005241723A

United States Patent [19]

Garrabrant

[11] Patent Number: 5,241,723

[45] Date of Patent: Sep. 7, 1993

[54] NOZZLE STRUCTURE WITH IMPROVED STREAM COHERENCE

[75] Inventor: Michael A. Garrabrant, Reynoldsburg, Ohio

[73] Assignee: The Babcock & Wilcox Company, New Orleans, La.

[21] Appl. No.: 780,724

[22] Filed: Oct. 21, 1991

[51] Int. Cl.[5] ..... B08B 9/02

[52] U.S. Cl. ..... 15/316.1; 122/390; 134/167 C; 165/95; 239/DIG. 13; 239/553.5

[58] Field of Search ..... 134/167 R, 167 C, 168 R, 134/168 C, 172, 180, 181; 15/316.1; 239/DIG. 13, 553.5; 122/390, 391, 392; 165/95; 201/2; 202/241; 196/122

[56] References Cited

U.S. PATENT DOCUMENTS

| | | | |
|---|---|---|---|
| 3,311,092 | 3/1967 | McMahon et al. | 122/392 |
| 4,452,183 | 6/1984 | Yazidjian | 122/392 |
| 4,565,324 | 1/1986 | Rebula et al. | 239/DIG. 13 |
| 4,567,622 | 2/1986 | Ziels | 15/316.1 |
| 4,620,881 | 11/1986 | Booij | 122/392 X |
| 4,676,201 | 6/1987 | Laboda et al. | 122/392 |

FOREIGN PATENT DOCUMENTS

| | | | |
|---|---|---|---|
| 0157927 | 9/1982 | Japan | 15/316.1 |
| 157927 | 9/1982 | Japan . | |
| 116130 | 4/1946 | Sweden . | |
| 2112304 | 7/1983 | United Kingdom | 165/95 |

*Primary Examiner*—Philip R. Coe
*Attorney, Agent, or Firm*—Harness, DIckey & Pierce

[57] ABSTRACT

A nozzle assembly for discharging jets of cleaning fluid from the end of a sootblower lance tube. The nozzle assembly includes a conduit within the lance tube. The conduit includes an inlet end, a discharge end and has a bore extending generally centrally therethrough. The conduit exhibits a length which is greater than the diameter of the lance tube and produces a discharged jet of improved coherency.

23 Claims, 1 Drawing Sheet

NOZZLE STRUCTURE WITH IMPROVED STREAM COHERENCE

BACKGROUND AND SUMMARY OF THE INVENTION

The present invention relates to cleaning apparatuses of the type used for cleaning soot, slag, ash and other accumulated deposits from heat exchange surfaces to maintain efficiency in their operation. More specifically, the present invention includes a nozzle structure which is particularly applicable, but not necessarily limited, to sootblower cleaning devices such as those types used in cleaning large scale boilers.

Generally, sootblowers include a lance tube which is connected to a pressurized source of blowing medium. In a retractable sootblower, the lance tube is advanced into and retracted from the interior of the boiler as the blowing medium is discharged in a stream or jet from nozzles on the end of the lance tube. In a stationary sootblower, also known as a wallblower, the lance tube is fixed in position within the boiler and the blowing medium is discharged from nozzles positioned therealong. In either type, the impact of the discharged blowing medium with the deposits accumulated on the heat exchange surfaces produces both a thermal and mechanical shock which dislodges the deposits U.S. Patents which generally disclose sootblowers include the following, which are hereby incorporated by reference U.S. Pat. Nos. 3,439,376; 3,585,673; 3,782,336; and 4,422,882.

A continuing problem associated with cleaning in this fashion is the tendency of the discharged jet of blowing medium to lose its coherency and integrity between the time it is discharged and the time it is impinged upon the surface being cleaned. Various factors contribute to the loss of coherency, including the disturbance of the jet by convection currents within the boiler and the existence of turbulent blowing medium flow patterns in the nozzle structure itself. These and other disturbances produce a fanning out of the jet reducing the average and maximum jet velocity, and also lowering the peak impact force at impingement. As a result, the effectiveness and efficiency of the cleaning operation per mass of fluid discharged is reduced. While the coherency problem is encountered at short cleaning distances, e.g. 12 inches, it is particularly pronounced at the extreme cleaning distances common in high capacity pressure boilers, e.g. 36 inches and beyond. The foregoing problem is aggravated by the limitations on nozzle design and nozzle inlet conditions due to the restricted mounting space available within the lance tube.

Conventional sootblower nozzles are positioned perpendicular to the flow of blowing medium within the sootblower lance tube and define a straight nozzle passageway directing the fluid discharge in a radial direction. Therefore, the length of the nozzle is limited to less than inside diameter of the lance tube. Since stream coherence generally improves with increases in the ratio of the nozzle length to its diameter, termed the L/D ratio, conventional nozzles have limited coherence potential.

An additional problem generally associated with the nozzle design and particularly associated with lance tube design is that the distal end of the lance tube, that end being inserted into the boiler, is subjected to extreme temperatures. The resulting damage often requires replacement of the lance tube at a considerable expense.

With the above considerations in mind, it is an object of the present invention to provide an improved nozzle structure having enhanced cleaning efficiency and effectiveness.

A related object of the invention is therefore an increase in the cleaning effectiveness per mass of fluid discharged from the lance tube.

Another object of the invention is the prevention of thermal damage to the distal end of the lance tube.

The objects, benefits and advantages of the present invention are achieved by providing the lance tube with an improved nozzle structure. The nozzle structure is adapted to be supported in the wall of the lance tube and comprises a conduit or tubular element having a bore extending substantially centrally therethrough to define an inlet opening and a discharge opening. The inlet opening is in communication with the interior of the lance tube while the discharge opening is disposed for discharging the fluid blowing medium in a directionally oriented jet.

The conduit of the nozzle exhibits a length which is substantially greater than the diameter of the bore extending therethrough. Thus, the nozzle structure exhibits a high length to diameter (L/D) ratio. The conduit is also of an orientation which aligns that portion defining the inlet opening, hereinafter the inlet throat, substantially axially with the lance tube. A further feature of the present nozzle structure is that the inlet opening of the conduit is preferably oriented in a direction facing the distal end of the lance tube.

Positioned within and adjacent to the distal end of the lance tube is a means for reversing the flow direction of the fluid blowing medium therein. This reversal or redirection serves several purposes. One is that it directs the flow of fluid blowing medium into the inlet opening and throat of the conduit. Also, since the redirecting means is in surface-to-surface contact with the distal end of the lance tube, heat is transferred from the distal end of the lance tube to the fluid blowing medium thereby cooling the tip or end of the lance tube.

Two embodiments of the present invention are being disclosed. In either embodiment, the flow of fluid blowing medium is reversed at the distal end of the lance tube, cooling the end of the tube, and directed generally axially into the inlet throat of the conduit. By directing the flow of fluid blowing medium axially into the conduit, the characteristics of the flow pattern are improved to a more laminar state by the high L/D ratio of the conduit. This results in better jet coherency at greater distances from the discharge opening and also results in an increased cleaning efficiency per mass of fluid discharged. At discharge, the fluid blowing medium has been shaped into a tight, high velocity jet which is resistant to the cross current influences of convection gases present in the boiler.

Additional benefits and advantages of the present invention will become apparent to those skilled in the art to which this invention relates from the subsequent description of the preferred embodiments and the apparent claims, taken in conjunction with the accompanying drawings.

DETAILED DESCRIPTION OF THE PREFERRED EMBODIMENTS

Figure 1:
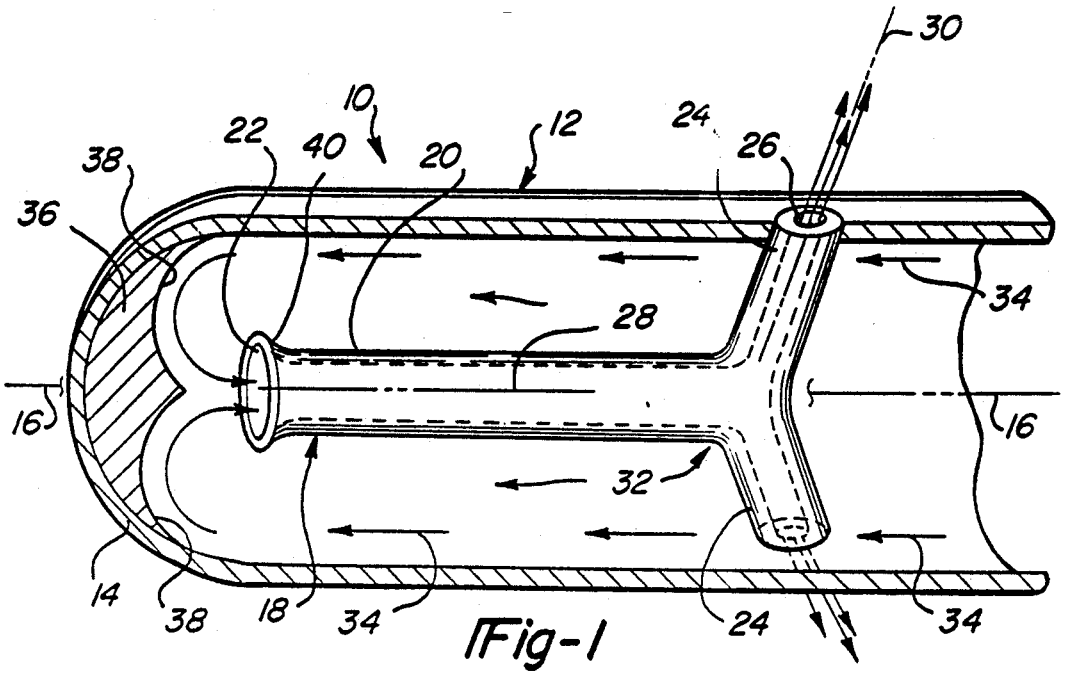
FIG. 1 is a sectional view of a nozzle assembly mounted in a lance tube end and incorporating the principles of the present invention.

Referring now to the drawing, a nozzle assembly incorporating the principles of the present invention is illustrated in FIG. 1 and generally designated at 10. The nozzle assembly 10 is illustrated as being mounted in a sootblower lance tube 12 which is closed at its outboard or distal end by a hemispherical wall 14. Generally, the lance tube 12 is inserted reciprocally into a large scale boiler or furnace to clean the heat exchanging and other interior surfaces. Cleaning is performed by discharging a fluid blowing medium, such as air, water or steam from the nozzle assembly 10 and impinging materials such as soot, slag and ash which have become deposited on the various interior surfaces.

The lance tube 12 is affixed to a motor driven carriage (not shown) which controls the movement of the lance tube. Generally, a drive system (not shown) of the carriage simultaneously imparts rotational and longitudinal motion to the lance tube 12 as the tube 12 is cycled into and withdrawn from the boiler during performance of its cleaning functions. The interior of the lance tube 12 is in communication with a pressurized supply of fluid blowing medium which is to be discharged from the nozzle assembly 10 during a cleaning cycle. It is anticipated that the nozzle assembly 10 of the present invention will find particular utility wherein the fluid blowing medium is a liquid e.g. water. In such a case, the lance tube 12 may be connected to a pump (not shown) by a flow control valve (not shown) which supplies the fluid blowing medium to the lance tube 12 in accordance with the cleaning requirements of the heat exchanging apparatus. While the nozzle structure 10 is being described in connection with a retractable sootblower, the invention should not be read as being so limited since the nozzle structure 10 will also find utility in non-retractable sootblowers.

At the initiation of a cleaning cycle, the lance tube 12 is axially advanced from a retracted position, exterior of the heat exchanging apparatus, to an inserted cleaning position. The lance tube 12 is then subsequently withdrawn. During insertion and retraction, the lance tube 12 can be rotated such that the fluid blowing medium is discharged in a helical path against the heat exchange surfaces to be cleaned.

Figure 2:
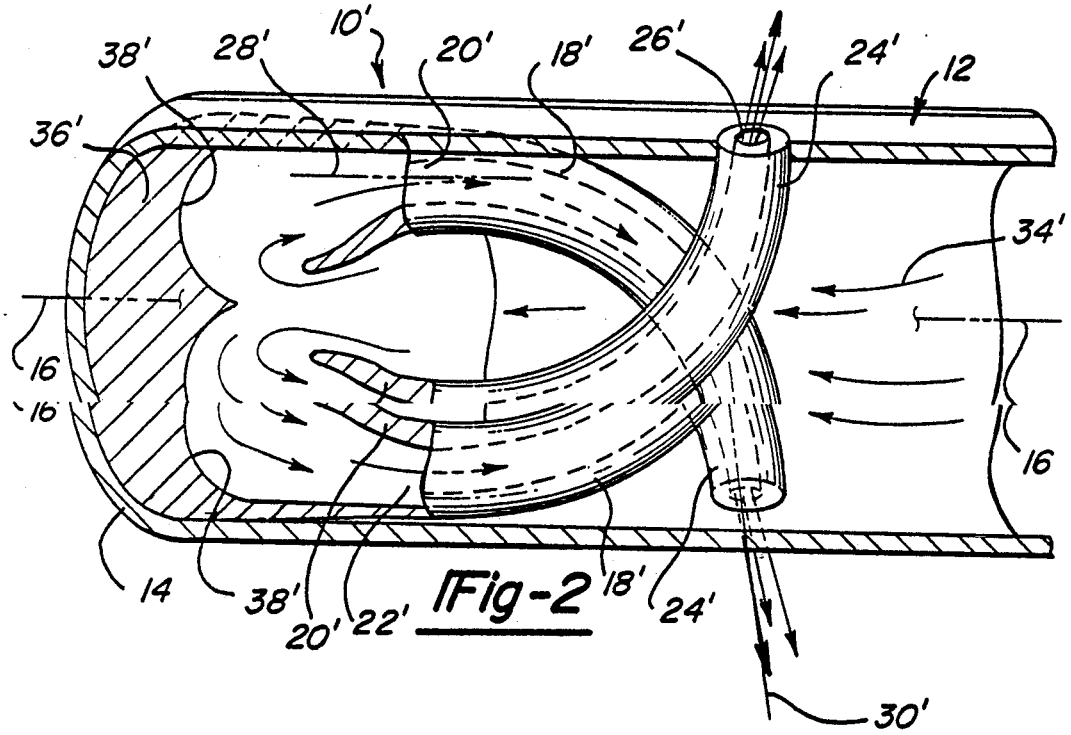
FIG. 2 is a sectional view of a second embodiment of a nozzle structure mounted in the end of a lance tube and incorporating the principles of the present invention.

The insertion axis of the lance tube is generally illustrated by the line designated at 16. The insertion axis 16 will be used as a reference axis from which the orientation of other elements will be described. A first embodiment of the nozzle assembly 10 according to the present invention is generally illustrated in FIG. 1. A second embodiment is generally illustrated in FIG. 2.

Referring now to the embodiment of FIG. 1, the nozzle assembly 10 includes a primary body or conduit 18. The conduit 18 is formed with a bore extending substantially centrally therethrough and further includes an inlet throat section 20, defining an inlet opening 22, and a pair of discharge throat sections 24 each defining a discharge opening 26. The inlet opening 22 is oriented so as to face toward the distal end and hemispherical wall 14 of the lance tube 12. An inlet axis, generally designated at 28, is coaxially defined with the insertion axis 16 by the inlet throat section 20. The inlet throat section 20 itself extends a distance along the inlet axis 28 until diverging along a pair of discharge axes 30 which are respectively defined by the two discharge throat sections 24. This provides the conduit 18 with the T or Y configuration seen at 32.

In the preferred embodiments, the discharge axes 30 are set at a backrake angle which will direct the jet of fluid blowing medium not only against the heat exchanging surfaces, but also against the interior wall surfaces of the heat exchanger apparatus to which the sootblower is mounted. Generally, the discharge axes 30 is oriented with a backrake angle of about seventy degrees (70°). However, the orientation of the discharge axes 30 could be substantially perpendicular to the insertion axis 16 of the lance tube 12. The actual orientation of the discharge axes 30 will be determined by the specifics of the cleaning operation to be performed.

The flow of fluid blowing medium from the pressurized source through the lance tube 12 is generally axial along the insertion axis 16 and is generally illustrated by flow arrows 34. To direct the flow 34 into the inlet opening 22 of the conduit 18, the nozzle assembly 10 is provided with a flow reverser 36. The flow reverser 36 is mounted within the lance tube 12 adjacent to the distal end and hemispherical wall 14. As the flow 34 initially reaches the nozzle assembly 10, it is substantially along the sides of the lance tube 12 because the conduit 18 is centrally positioned therein. When the flow 34 encounters the flow reverser 36, the flow 34 is directed inwardly toward the insertion axis 16 and reversed approximately 180° along curved surfaces 38 toward the inlet opening 22 of the conduit 18. The curved surfaces 38 may be generally described as having a complimentary toroidal shape.

In addition to reversing the fluid flow 34, the flow reverser 36 assists in cooling the distal end of the lance tube 12. With the fluid flow 34 being continually directed over the flow reverser 36 during a cleaning cycle, heat is readily transferred from the distal end of the lance tube 12 through the flow reverser 36 to the cooler fluid flow 34. Thus, damage to the tip or distal end of the lance tube 12 caused by overheating is avoided.

The curved surfaces 38 are smooth so that once reversed, the flow 34 is directed into the inlet opening 22. To assist the entrance of the flow 34 into the conduit 18, the distal end of the conduit is provided with an outward flare 40. In the conduit 18, the flow becomes more laminar as a result of the conduit's high L/D ratio (its length being large compared to its diameter). While laminar flow in the conduit 18 is slightly disrupted when it reaches the T or Y configuration 32, it is quickly reestablished since the discharge throat section 24 also exhibits a high L/D ratio.

As can be seen from the above discussion, the flow 34 of fluid blowing medium reaches the discharge opening 26 of the lance tube 12 in a substantially laminar state. The flow through the conduit 18 of the present invention produces a tight fluid jet. In other words, the jet exhibits an increased coherency and integrity and is less susceptible to the convection currents present within the boiler.

A second embodiment of the present invention is generally illustrated in FIG. 2. While containing a significant number of common features, for the sake of clarity the second embodiment and its corresponding structures will be hereinafter given a prime designation.

In the second embodiment, the fluid flow 34' through the lance tube 12 is generally along the insertion axis 16 until being redirected by a flow reversing member, hereinafter flow reverser 36'. The flow reverser 36' is mounted internally of the lance tube 12 adjacent to the distal end and hemispherical wall 14. The fluid flow 34' is directed outwardly from the insertion axis 16 along curved surfaces 38' and reversed in direction into a conduit 18'.

Unlike the first embodiment, the second embodiment is provided with two conduits 18' being oppositely positioned from one another within the lance tube 12. Each conduit 18' is formed with a bore extending substantially centrally therethrough and includes an inlet throat section 20', defining an inlet opening 22', and a discharge throat section 24' defining a discharge opening 26'. The inlet throat sections 20' define inlet axes 28' which are generally parallel to the insertion axis 16.

In proceeding along the length of the conduits 18', the conduits 18' themselves, including the bore, exhibit a smooth curve before reaching the discharge openings 26', discharge throat sections 24' and the discharge axes 30' defined thereby. For the reasons stated above, the discharge axes 30' preferably exhibits a backrake angle between seventy degrees (70°) and ninety degrees (90°), as measured up from the insertion axis 16. As with the previous embodiment, laminar flow is induced within the conduits 18' as a result of the high L/D ratio.

As seen in the figures, the length of the conduits 18 and 18' may actually exceed the diameter of the lance tube 12. Previous designs were limited to a length being less than the lance tube radius, when the nozzles were diametrically opposed, or being less than the lance tube diameter when the nozzles were not oppositely positioned. With the nozzle assembly 10 and 10' of the present invention, the length of the nozzle is no longer constrained by the diameter of the lance tube.

Preferably, the nozzle structures 10 and 10' are formed of cast metal and therefore require only a minimal amount of final machining prior to installation. The flow reverser 36' may be integrally formed with the conduits 18', as seen in FIG. 2, or separately formed as shown in FIG. 1. With either embodiment, the ease with which the nozzle assembly 10 or 10' is mounted to the lance tube 12 is increased because the assemblies 10 and 10' may be snap-fit into holes predrilled in the lance tube 12 specifically for that purpose.

Although the above description constitutes the preferred embodiments of the present invention, it will be appreciated that the invention is susceptible to modification, variation and change without departing from the proper scope and fair meaning of the accompanying claims.

What is claimed is:

1. In a sootblower for cleaning heat exchange surfaces within a boiler by impingement of a jet of fluid blowing medium thereagainst, said sootblower including a lance tube defining a longitudinal axis and a hollow passageway and having a proximal end and a distal end, and means for supplying said fluid blowing medium to said proximal end for subsequent discharge from said lance tube, a nozzle assembly comprising:

at least one hollow conduit positioned in said lance tube passageway, said conduit having a passageway with a diameter being less than an inner diameter of said lance tube and having a length being greater than said inner diameter of said lance tube, said conduit defining an inlet opening facing said distal end, said fluid blowing medium being received into said inlet opening, and said conduit also includes a discharge opening through which said fluid blowing medium is discharged from said lance tube against said heat exchange surfaces, and said conduit passageway extending between said inlet opening and said discharge opening, said conduit being continuously open and in communication with the interior of said lance tube to provide for discharge of said blowing medium through said discharge opening whenever said blowing medium is being supplied to said lance tube, said conduit providing a continuous, uninterruptable flow path between said inlet and discharge openings.

2. The nozzle assembly defined in claim 1 wherein said sootblower includes means for advancing and retracting said lance tube from said boiler along said axis.

3. The nozzle assembly defined in claim 1 wherein said inlet opening is oriented in a direction facing said distal end of said lance tube whereby said fluid flows from said proximal end to said distal end, reverses direction, and flows into said inlet opening.

4. The nozzle assembly defined in claim 1 wherein said conduit is in close proximity to said distal end of said lance tube.

5. The nozzle assembly defined in claim 1 wherein said conduit includes a bend between said inlet opening and said discharge opening.

6. The nozzle assembly defined in claim 5 wherein said bend is a smooth curve inducing substantially laminar flow of said fluid blowing medium through said conduit to said discharge opening.

7. A nozzle assembly for discharging jets of blowing medium from an end of a sootblower lance tube to clean heat exchange surfaces within a boiler by impingement of said jets thereagainst, said sootblower lance tube defining a longitudinal axis and having a proximal end in communication with a pressurized source of blowing medium and having a nozzle assembly at a distal end, said nozzle assembly comprising:

a hollow conduit being positioned interiorly of said sootblower lance tube and being mounted to a peripheral wall thereof, said conduit having a passageway of a diameter less than an inner diameter of said lance tube and having a length being greater than said inner diameter of said lance tube, said conduit being continually in communication with the interior of said sootblower lance tube for receiving said blowing medium thereinto, said conduit having an inlet opening and said inlet opening facing said distal end, said inlet opening positioned within said lance tube inner diameter and said conduit extending from said inlet opening and diverging in a plurality of discharge portions defining a corresponding plurality of discharge openings for discharging said blowing medium from said sootblower lance tube in directionally oriented jets, a continuous, uninterruptable flow path being defined between said inlet and discharge openings such that whenever said blowing medium is provided to said lance tube it will be discharged through said discharge openings.

8. A nozzle assembly as set forth in claim 7 further comprising means for directing said blowing medium into said inlet opening, said directing means being mounted interiorly of said lance tube and adjacent said distal end thereof.

9. A nozzle assembly as set forth in claim 8 wherein said directing means substantially reverses the direction of the flow of said blowing medium within the lance tube.

10. A nozzle assembly as set forth in claim 8 wherein said inlet opening is spaced apart from said directing means.

11. A nozzle assembly as set forth in claim 7 wherein said inlet opening is positioned generally co-axially within said sootblower lance tube passageway.

12. A nozzle assembly as set forth in claim 7 wherein the length of said conduit passageway is greater than the diameter of said bore extending therethrough.

13. A nozzle assembly as set forth in claim 7 wherein the length of each of said discharge portions is greater than the diameter of said bore extending therethrough.

14. A nozzle assembly as set forth in claim 7 wherein said inlet opening is oriented in a direction facing toward said distal end of said sootblower lance tube whereby said fluid flows from said proximal end to said distal end, reverses direction, and flows into said inlet opening.

15. A nozzle assembly as set forth in claim 7 wherein said distal end is insertable within said boiler.

16. In a sootblower for cleaning heat exchange surfaces within a boiler by impingement of a jet of fluid blowing medium thereagainst, said sootblower including a lance tube defining a longitudinal axis and a hollow passageway and having a proximal end and a distal end, and means for supplying said fluid blowing medium to said proximal end for subsequent discharge from said lance tube, a nozzle assembly comprising:

at least one hollow conduit positioned in said lance tube passageway, said conduit having a passageway with a diameter being less than an inner diameter of said lance tube and having a length being greater than said inner diameter of said lance tube, said conduit defining an inlet opening where said opening is oriented in a direction facing said distal end of said lance tube and said fluid flows from said proximal end to said distal end, reverses direction, and flows into said inlet opening, and said conduit also includes a discharge opening through which said fluid blowing medium is discharged from said lance tube against said heat exchange surfaces, and said conduit passageway extending between said inlet opening and said discharge opening; and means for cooling said distal end of said lance tube, said cooling means being positioned within said lance tube and having a surface in contact with said fluid blowing medium whereby heat is transferred from said distal end through said cooling means to said fluid blowing medium, said surface having a predetermined shape directing said fluid blowing medium into said inlet opening of said conduit for said subsequent discharge through said discharge opening.

17. In a sootblower for cleaning heat exchange surfaces within a boiler by impingement of a jet of fluid blowing medium thereagainst, said sootblower including a lance tube defining a longitudinal axis and a hollow passageway and having a proximal end and a distal end, and means for supplying said fluid blowing medium to said proximal end for subsequent discharge from said lance tube, a nozzle assembly comprising:

at least one hollow conduit positioned in said lance tube passageway, said conduit having a passageway with a diameter being less than an inner diameter of said lance tube and having a length being greater than said inner diameter of said lance tube, said conduit defining an inlet opening where said opening is oriented in a direction facing said distal end of said lance tube and said fluid flows from said proximal end to said distal end, reverses direction, and flows into said inlet opening, and said conduit also includes a discharge opening through which said fluid blowing medium is discharged from said lance tube against said heat exchange surfaces, and said conduit passageway extending between said inlet opening and said discharge opening; and means for cooling said distal end of said lance tube, said cooling means being positioned in close proximity to said distal end within said lance tube and having a surface in contact with said fluid blowing medium whereby heat is transferred from said distal end through said cooling means to said fluid blowing medium, said surface having a predetermined shape directing said fluid blowing medium into said inlet opening of said conduit for said subsequent discharge through said discharge opening.

18. In a sootblower for cleaning heat exchange surfaces within a boiler by impingement of a jet of fluid blowing medium thereagainst, said sootblower including a lance tube defining a longitudinal axis and a hollow passageway and having a proximal end and a distal end, and means for supplying said fluid blowing medium to said proximal end for subsequent discharge from said lance tube, a nozzle assembly comprising:

at least one hollow conduit positioned in said lance tube passageway, said conduit having a passageway with a diameter being less than an inner diameter of said lance tube and having a length being greater than said inner diameter of said lance tube, said conduit defining an inlet opening where said opening is oriented in a direction facing said distal end of said lance tube and said fluid flows from said proximal end to said distal end, reverses direction, and flows into said inlet opening, and said conduit also includes a discharge opening through which said fluid blowing medium is discharged from said lance tube against said heat exchange surfaces, and said conduit passageway extending between said inlet opening and said discharge opening; and means for cooling said distal end of said lance tube, said cooling means being positioned in close proximity to said distal end within said lance tube and having a surface in contact with said fluid blowing medium whereby heat is transferred from said distal end through said cooling means to said fluid blowing medium, said surface having a predetermined shape directing said fluid blowing medium into said inlet opening of said conduit for said subsequent discharge through said discharge opening where said inlet opening is positioned in close proximity to said cooling means.

19. A nozzle assembly for discharging jets of blowing medium from an end of a sootblower lance tube to clean heat exchange surfaces within a boiler by impingement of said jets thereagainst, said sootblower lance tube defining a longitudinal axis and having a proximal end in communication with a pressurized source of blowing medium and having said nozzle assembly at a distal end, said nozzle assembly comprising:

a hollow conduit being positioned interiorly of said sootblower lance tube and being mounted to a peripheral wall thereof, said conduit having a passageway of a diameter less than an inner diameter of said lance tube and having a length being greater than said inner diameter of said lance tube, said conduit having an inlet opening in communication with the interior of said sootblower lance tube for receiving said blowing medium thereinto, said inlet opening positioned within said lance tube inner diameter and said conduit extending from said inlet opening and diverging in a plurality of discharge portions defining a corresponding plurality of discharge openings for discharging said blowing medium from said sootblower lance tube in directionally oriented jets; and means for directing said blowing medium into said inlet opening, said directing means being mounted interiorly of said lance tube and adjacent said distal end thereof, said directing means including a body having a surface of modified toroidal shape.

20. The improvement defined in claim 1 further comprising means for directing said blowing medium into said inlet opening, said means for directing being mounted interiorly of said sootblower lance tube adjacent to said distal end thereof.

21. The improvement defined in claim 20 wherein said means for directing substantially reverses the direction of the flow of said blowing medium within said lance tube.

22. The improvement defined in claim 20 wherein said means for directing includes a body having a surface of modified toroidal shape.

23. The improvement defined in claim 20 wherein said means for directing is integrally formed with said conduit.

* * * * *